United States Patent [19]

Durham, Sr.

[11] 4,239,232

[45] Dec. 16, 1980

[54] GAME OF CADDY

[76] Inventor: Vernon O. Durham, Sr., 200 11th Ave., Baltimore, Md. 21225

[21] Appl. No.: 964,477

[22] Filed: Nov. 29, 1978

[51] Int. Cl.[3] ..... A63B 67/00

[52] U.S. Cl. ..... 273/341

[58] Field of Search ..... 273/95 H, 95 F, 95 R, 273/80 D, 106 R, 105 R, 341; 272/3

[56] References Cited

U.S. PATENT DOCUMENTS

| | | | |
|---|---|---|---|
| 229,791 | 7/1880 | Wunderlich | 273/95 F |
| 697,457 | 4/1902 | Doering | 273/95 R |
| 910,903 | 1/1909 | Carey | 273/106 R |
| 1,873,211 | 8/1932 | Nekuda | 273/95 F |
| 3,424,464 | 1/1969 | Greenhouse | 273/80 D |
| 3,490,769 | 1/1970 | Torbett | 273/105 R |
| 4,037,837 | 7/1977 | Bauer | 273/95 H |
| 4,052,065 | 10/1977 | Rodriquez | 273/95 F |
| 4,054,987 | 10/1977 | Forlenza | 272/3 |

OTHER PUBLICATIONS

Archie Comic Strip, Philadelphia Sunday Bulletin, May 17, 1953.

*Primary Examiner*—William H. Grieb
*Attorney, Agent, or Firm*—Walter G. Finch

[57] ABSTRACT

The invention is a game in which a small piece, called a caddy, is pitched or thrown by a player of one side to a specified location, with certain restrictive requirements, and a player of the other side thereafter, under certain requirements, may play upon the small game piece or caddy with a bat-like game piece in a particular manner. A scoring system is established based on plays made with the bat-like game piece and the caddy and the resulting action taken by the opposing side.

5 Claims, 9 Drawing Figures

GAME OF CADDY

BACKGROUND AND SUMMARY OF THE INVENTION

The invention relates to games and in particular to field games played with game pieces, specifically, a game played with stick-like game pieces.

Numerous games requiring pitching or throwing expertise have been developed and, likewise, numerous games have been developed requiring various techniques in batting or hitting an object. This invention provides expertise, batting or hitting techniques, and in addition, a special expertise and technique in control of a game piece and in estimating distances.

Several methods of scoring are provided to provide for a range of skills of various ages of players.

A flexible layout of a playing area is also provided to meet the capabilities and limitations of a range of ages and skills of players.

It is, therefore, an object of the invention to provide a game requiring skills in pitching and throwing.

It is another object of the invention to provide a game requiring skills in manipulating of a game piece.

It is still another object of the invention to provide a game requiring a batting skill and technique.

It is yet another object of the invention to provide a flexible playing area to meet the range of capabilities and limitations of a range of ages and skills of players.

It is a further object of the invention to provide a flexible scoring system to meet the range of capabilities and limitations of a range of ages and skills of players.

Further objects and advantages of the invention will become more apparent in the light of the following description of the preferred embodiments.

DESCRIPTION OF THE PREFERRED EMBODIMENT

Figure 1:
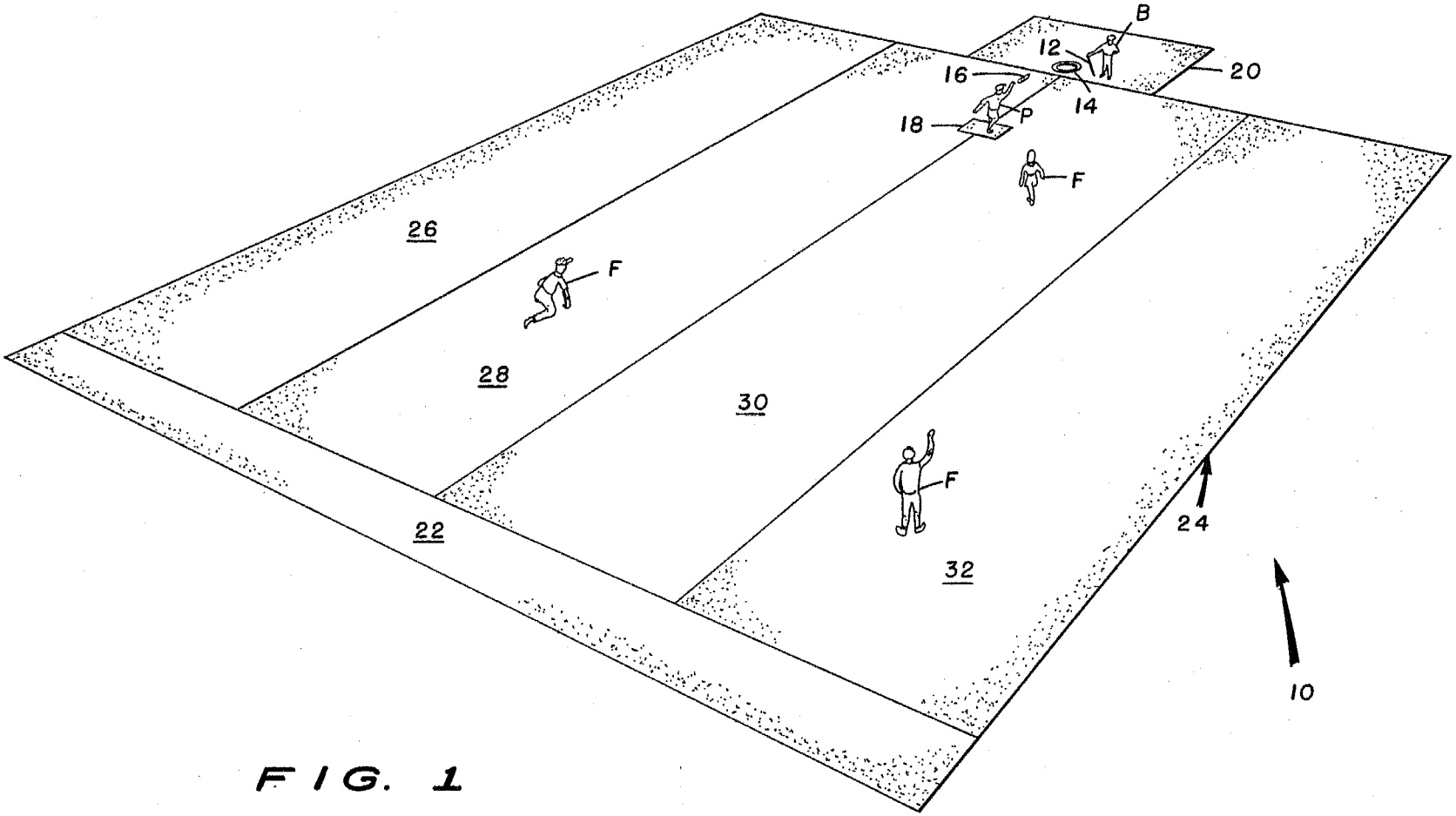
FIG. 1 is a pictorial view of the playing area and showing relative player positions.

Referring to the drawings, and particularly to FIG. 1, a typical playing area or playing field with typically positioned players and located playing equipment is shown at 10.

The playing area or playing field or fielding area is shown at 24. The main playing area or playing field 24 is usually divided into lanes 26, 28, 30, and 32. It is to be noted that the number of lanes will depend upon the number of players. Four lanes 26, 28, 30, and 32 are shown and four players P, F, F, and F on the "out" team. If just two players were playing, one on each side as this game may be played, then only one general area or lane is needed.

While the lanes 26, 28, 30, and 32 may be formally marked on the ground, it is to be understood that the game may by played on agreement without lane markings and with any make-shift designation of the playing area or playing field 24 outside limits.

The playing area of playing field 24 has a bonus area 22 at the end of the lanes 26, 28, 30, and 32 most distant from the batter player B.

A batter player box 20 is at the end of the playing area or playing field 24.

At a measured distance from the center of the batter player box 20 is a pitcher player box 18.

Regarding the widths and lengths of lanes 26, 28, 30, and 32, bonus area 22, batter player box 20, and pitcher player box 18, the dimensions may be flexibly adjusted to meet the capabilities and limitations of the participating players by age and skill. Such flexibility of dimensions includes the distance of the pitcher player box 18 from the batter player box 20.

Four players on an "out" team are shown at P, F, F, F. The fielders F normally play in a single lane 26, 28, 30, and 32, though modifications to such a rule may be made on an agreement of the teams. The pitcher or thrower for the "out" team is shown as P in the pitcher player's box 18.

A pitching target ring 14 is shown in the batter player's box 20 just outside the end of lanes 28 and 30 and centered in line with the pitcher player box 18 which straddles the line separating lanes 28, and 30.

The pitcher player P is shown pictorially pitching or throwing the caddy 16 toward the pitching target ring 14. The batter player B, holding caddy control stick and bat 12, stands clear of the pitching target ring 14 and does not interfere with the caddy 16 as it comes to the area of the pitching target ring 14 and the batter player's box 20 and finally comes to rest in or outside the pitching target ring 14.

If the caddy 16 comes to rest inside the pitching target ring 14, the batter player is "out" and the next batter player on the team takes the position as the batter player. It is to be noted that the caddy 16 must be entirely within the interior circular area of the pitching target ring 14 to put the batter player "out". Any position of the caddy 16 resting on or projecting over any part of the pitching target ring 14 is not "out". Three "outs" and the teams changes positions. It is to be noted that there are othermeans of scoring an "out" as hereinafter described.

If the caddy 16 is not inside the pitching target ring 14, the batter player then plays the caddy 16 with the caddy control stick and bat 12. The manner of playing the caddy 16 with the caddy control stick and bat 12 will be described hereinafter when the caddy 16 and caddy control stick and bat 12 are described in detail. For now, the scoring on the play of the caddy 16 will be described.

If the batter player B takes three "strokes" or 4 "strikes" at the caddy 16 and either misses it or hits it but does not put it in play, the batter player B is "out". If the batter player hits the caddy 16 and is able to put it play by battiing it in with the caddy control stick and bat 12 toward the opposing team of players P, F, F, and F and one of the opposing team players catches it with one hand, the batter player is "out".

If, on the other hand, the batter player B puts the caddy 16 in play as hereinbefore described and it falls to the ground in any lane 26, 28, 30, or 32 or in the bonus box 22 the batter player is in a position to score points for the team.

If the caddy 16 lands in the bonus zone 22, the batter player B's team automatically scores 50 points. If the caddy 16 goes beyond the bonus zone 22 or outside the side limits of lanes 26 or 32, the batter player B is "out", thus requiring a degree of skill and control in placing the caddy 16.

When the caddy 16 lands in the bonus zone 22 or any lane 26, 28, 30, or 32, without being caught by an opposing player, the batter player B estimates the number of strides from the caddy 16 to the center of the pitching target ring 14. Each player on the opposing team P, F, F, and F, is assigned to one of the lanes 26, 28, 30, or 32. The player assigned to the lane where the caddy 16 rests must then try to put the batter player B "out". The player has three choices: he may stride from caddy 16 to the center of pitching target ring 14 in the estimated number of strides or less; he may pitch or throw the caddy 16 into the pitching target ring 14; or he may challenge the batter player B to stride the distance in the estimated number of strides or less (this latter challenge privilege is to prevent the batter player B from making a ridiculously low estimate that would be impossible to achieve). If no "out" is scored the estimated strides are added to the score of the batter player's team.

Variations of the scoring can be used to match the skill and capabilities and limitations of the players. The striding can be done by starting from rest at the caddy and take walking strides or jumping strides, or by using a running start for strides. Whatever method of scoring is used, the agreement must be made before the game begins. Regarding the estimated strides, a minimum may be set, such as 5 or 10 strides, so that all estimates must be the minimum or more.

If the batter player B is not put "out" by any of the foregoing methods, the batter player B continues to be the batter player until he is "out". Each player on the opposing team takes turns at pitching the caddy 16, and each player always pitches to the same batter player. Variations may be practiced where one player does all of the pitching, or where each player takes a turn at pitching until three are "out". The preferred embodiment is for each player to pitch to one batter player each time that batter player is batting.

As noted previously, one or more players on each side or each team may play the game. Four players on each team is the preferred embodiment.

When less than three players are on each team, the team is "out" when each player has been put "out".

A game may be determined either by a preset number of times at bat for each team, or by the first to reach a specified score. First to bat may be determined by the toss of a coin or by the "home team /visting team" arrangement where the visting team bats first.

When a batter player B is to play the caddy 16, he has the choice of playing it where it lies or moving it into the pitching target ring 14. After the first stroke or strike at the caddy 16, the caddy must be played where it lies.

A variation in the stride estimating and "out" procedure is for the team playing the field to not only score an "out", but to receive the number of points involved in the estimate.

Figure 2:
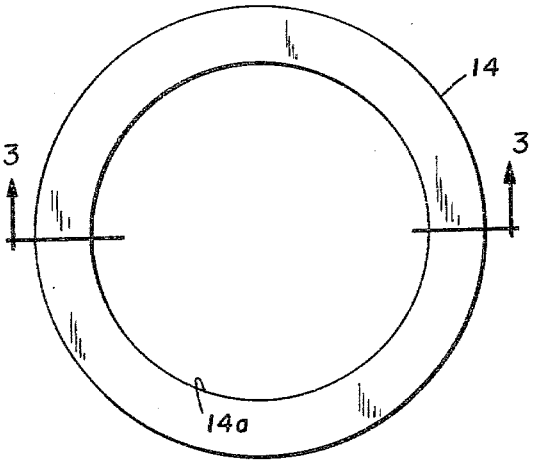
FIG. 2 is a plan view of pitching target ring.
Figure 3:
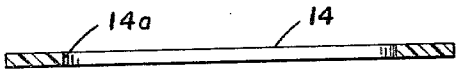
FIG. 3 is a cross section view on line 3—3 of FIG. 2.

Turning now to FIGS. 2 and 3, the pitching target ring 14 is seen in FIG. 2, with a cross sectional view in FIG. 3, taken on line 3—3 of FIG. 2. Note the hollow interior ring 14*a*. The pitching target ring 14 is a flat configuation as can be seen in FIG. 3.

Figure 4:
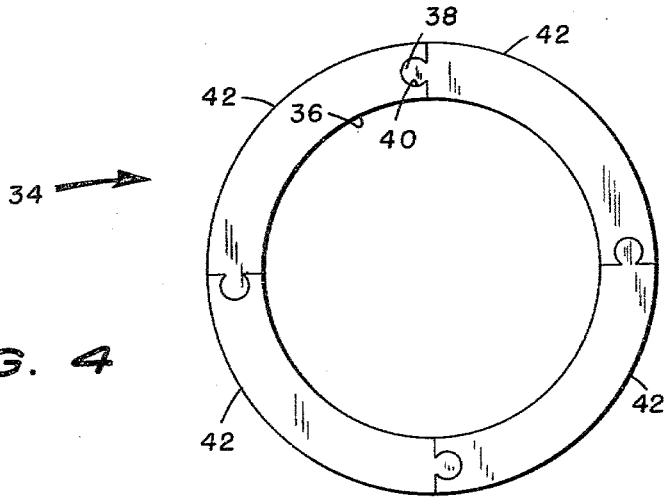
FIG. 4 is a plan view of a segmented pitching target ring.

In order to pack the pitcings target ring 14 for transport, packaging, or storage it can be made in sections or segments as shown in FIG. 4 at 34. This knock-down pitching target ring 34 is made in four sections or segments 42. The inner ring 36 corresponds to the hollow interior ring 14*a*. The sections or segments 42 interlock with each other by the configuration in a partial circular male member 38 on one end of a section 42 interlocking with a circular female member 40 on the end of the next adjacent segment 42.

Figure 5:
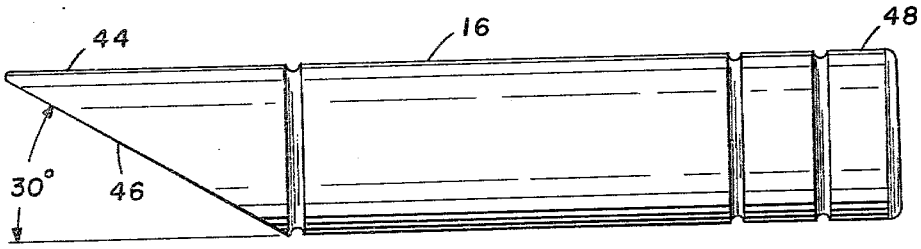
FIG. 5 is a side view of a caddy.
Figure 6:
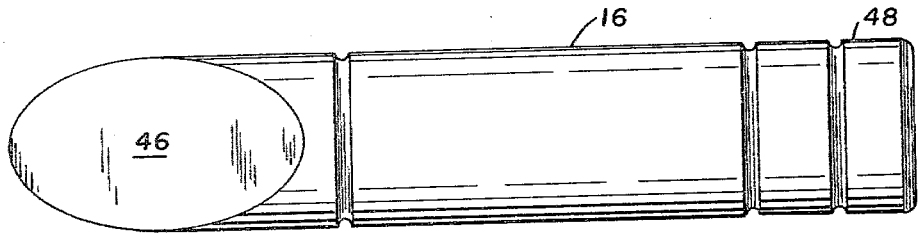
FIG. 6 is a bottom view of a caddy.

The caddy 16 is shown in FIGS. 5 and 6. One end of caddy 16 is blunt-like, this is the rear end 48, the opposite end is tapered as shown by the tapered face 46. The taper is shown as 30°, but it is to be understood that any degree of taper may be used, so long as it is efficient in putting the caddy 16 in play. The taper 46 may be made on more than one side. It is to be understood that this is within the scope and intent of this invention, though taper on one side only is the preferred embodiment.

Circular groove rings (not numbered) cut into the body of the caddy 16, as can be seen in FIGS. 5 and 6, are decorative.

Figure 7:
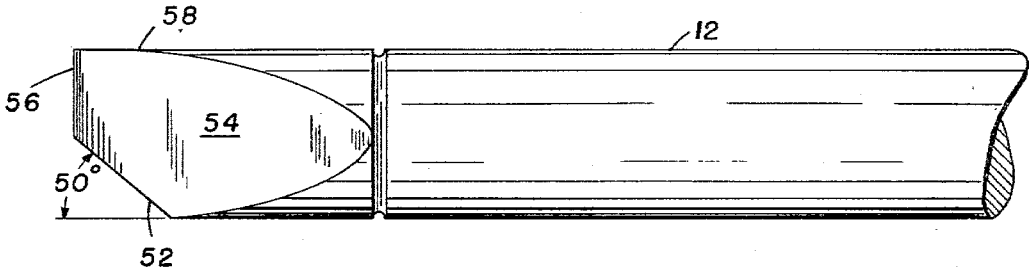
FIG. 7 is a side view of a portion of a caddy control stick and bat.
Figure 8:
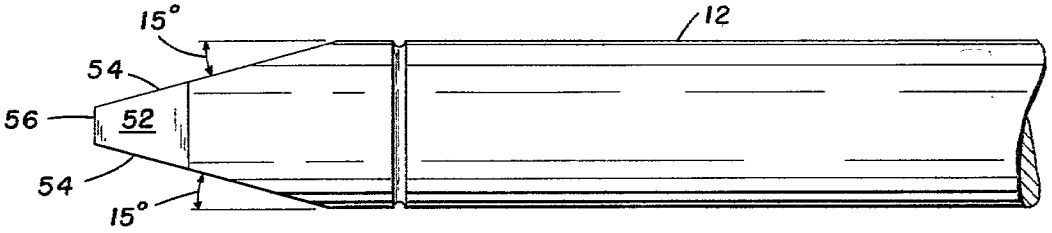
FIG. 8 is a bottom view of a portion of a caddy control stick and bat.
Figure 9:
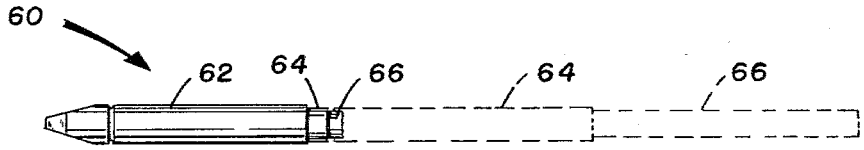
FIG. 9 is a telescoping caddy control stick and bat.

FIGS. 7 and 8 show the caddy control stick and bat 12. An unnumbered circular decorative groove is also shown cut into the caddy control stick and bat 12.

The working end of the caddy control stick and bat 12, comprises a side taper 54 on two sides and an underside taper 52. The two side tapers 54 and the underside taper 52 are so configured so as to produce a blunt nose 56 on the end of the caddy control stick and bat 12.

The side tapers 54 are shown as 15° each and the underside taper 52 is shown as 50°. It is to be understood that variations of these tapers are within the scope and intent of this invention.

To put the caddy 16 in play, the end of the caddy control stick and bat 12 is struck down upon the tapered end 46 of caddy 16 so as to make the caddy 16 fly upward. As the caddy 16 flips upward in a more or less spinning motion, the caddy control stick and bat 12 is used as a bat and swung horizontally to hit the caddy 16 and drive it out into the playing area or play field 24. As hereinbefore described, the batter player B gets three strokes to try and flip the caddy 16 into the air. If he fails in three strokes to flip the caddy 16 into the air or fails to hit it into the playing field 24 if it flips upward, then the batter player B is out.

The various tapered sides 54, the tapered underside 52, and the straight upper side 58 are used to control and produce various angle flips of the caddy 16 when such side is struck down upon the upperside 44 of the caddy 16. It is to be noted that these tapered portions of the end of the caddy control stick and bat 12 are the key to the technique and skill of obtaining the type of flip that produces the best possibilities for the capabilities and limitations of certain players for scoring.

The length of the caddy control stick and bat 12 can be varied according to the size and age of the player. As a convenience, the caddy control stick and bat 60 is made in the form of a telescoping rod-like structure. The end or first section 62 includes the head or end configuration piece, the second section 64 telescopes inside of and interlocks with the first section 62, and the third section 66 telescopes inside of and interlocks with the second section 64. Thus, the telescoping rod-like caddy control stick and bat can be adjusted to any length desired to fit players of various ages or sizes. The solid one-piece rod-like caddy control stick and bat 12, and the telescoping multi-piece rod like caddy control stick and bat 60 are two embodiments for the caddy control stick and bat.

Accordingly, modifications and variations to which the invention is susceptible may be practiced without departing from the scope and intent of the appended claims.

What I claim is:

1. A game for at least two players having playing rules and a scoring system, comprising:

a structured playing field having a pitching area, a batting area, a fielding area, and a bonus scoring area, said areas being separate and adjacent to each other;

a pitching target ring means, said pitching target ring means being formed of segments and having interlocking elements for locking the segments together, said pitching target ring means being located within said batting area;

a caddy means for pitching toward said pitching target ring means;

a means for controlling and batting said caddy means in a specified manner, said means for controlling and batting said caddy being tapered on the control end thereof in three directions at specified angles.

2. The game as recited in claim 1, wherein said structured playing field has said fielding area divided into a plurality of adjacent lanes, with said batting area centrally located at one end adjacent to at least one of said lanes, said bonus scoring area adjacent to ends of all lanes opposite to location of said batting area, and said pitching area centrally located within width of fielding area and in line with center of said batting area at a measured distance therefrom.

3. The game as recited in claim 1, wherein said caddy means is of rod-like configuration with one end thereof tapered, the taper being in one direction only and tapering from one side of rod-like caddy to the opposite side.

4. The game as recited in claim 1, wherein said means for controlling and batting said caddy means is of rod-like configuration, said control end thereof having taper in three directions at specified angles being tapered from two opposite sides toward a blunt end and a third side therebetween tapered toward said blunt end at a greater angle than said two opposite sides, said taper in three directions being utilized to obtain the type of flip that produces the best possibilities for the capabilities and limitation of players.

5. The game as recited in claim 1, wherein said pitching target ring means is formed of a thin flat configuration comprising two concentric circles with material of said pitching target ring means therebetween, with said pitching target ring means being divided into a plurality of removably assembled interlocking segments.

* * * * *